United States Patent [19]

Damiano

[11] 4,394,830

[45] Jul. 26, 1983

[54] FEEDBACK REDUCER FOR AN ACOUSTIC ELECTRIC GUITAR

[75] Inventor: Paul J. Damiano, Manchester, Conn.

[73] Assignee: RMI Corporation, Emerson, N.J.

[21] Appl. No.: 266,903

[22] Filed: May 26, 1981

[51] Int. Cl.[3] ..... G10D 1/08; G10G 7/00; G10H 3/18

[52] U.S. Cl. ..... 84/1.15; 84/1.16; 84/267; 84/453

[58] Field of Search ..... 84/1.15, 1.16, 267, 84/453

[56] References Cited

U.S. PATENT DOCUMENTS

| | | | |
|---|---|---|---|
| 3,636,809 | 1/1972 | Ezaki | 84/267 X |
| 3,992,972 | 11/1976 | Rickard | 84/1.16 |
| 4,024,788 | 5/1977 | Dunlap | 84/267 |
| 4,184,399 | 1/1980 | Zuniga | 84/1.15 |

*Primary Examiner*—Stanley J. Witkowski

*Attorney, Agent, or Firm*—McCormick, Paulding & Huber

[57] ABSTRACT

A feedback reducing device for an acoustic electric guitar is in the form of a plug adapted to be snugly received in the sound hole of a guitar. With the plug in place, the sound hole opening is completely covered and the amplified performance of the instrument is not significantly effected.

12 Claims, 7 Drawing Figures

FEEDBACK REDUCER FOR AN ACOUSTIC ELECTRIC GUITAR

BACKGROUND OF THE INVENTION

This invention relates to a feedback reducing device and deals more particularly with a device for reducing a feedback in an acoustic electric guitar.

Feedback can occur when an acoustic electric guitar is played in combination with a reasonably loud amplifier system, and when it occurs undesirable noise is produced. In such a guitar/amplifier system combination, feedback originates when the guitar strings vibrate at certain resonant frequencies and the sound frequencies of the speaker excite the top, or face portion, of the guitar. As a consequence of these conditions, the strings and guitar top add to the excitation of one another in a regenerative manner, and when the excitation of the strings reaches a certain level, an audible noise, similar to a hum or buzz, is produced. This feedback noise is not only annoying because of its undesirable sound but also because of its unpredictable occurrence.

It is known that an electronic graphic equalizer can be used to reduce feedback in an electric guitar/amplifier system combination. A graphic equalizer performs its feedback reducing task by minimizing the strength of sound vibrations from the speaker within a range of frequencies containing the feedback frequencies, but a graphic equalizer is expensive to purchase and may be cost-prohibitive to many guitar players.

It is, therefore, a general object of this invention to provide a low-cost device for reducing feedback in acoustic electric guitars.

SUMMARY OF THE INVENTION

This invention resides in a feedback reducing device in the form of a plug adapted to be snugly received in the sound hole of a guitar. The device is comprised of a plate for completely covering the opening of the sound hole and means attached to the plate for securing it over the sound hole opening.

With this device fitted into the sound hole, the occurrence of feedback is substantially reduced. The primary advantage associated with this device is that it reduces the feedback problem at a cost much less than that of a graphic equalizer without significantly affecting the amplified performance of the instrument.

This invention also resides in a feedback reducing device in the form of a plug for a guitar sound hole and which includes a magnetic pickup. In this device, the magnetic pickup is attached to the head of the plug. Since the addition of a magnetic pickup to an acoustic guitar will convert the guitar into an acoustic electric one, this single device provides for guitar conversion as well as for feedback reduction.

DETAILED DESCRIPTION OF THE PREFERRED EMBODIMENTS

Figure 1:
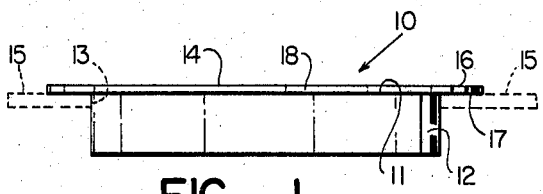
FIG. 1 is an elevational view of one embodiment of this invention.
Figure 2:
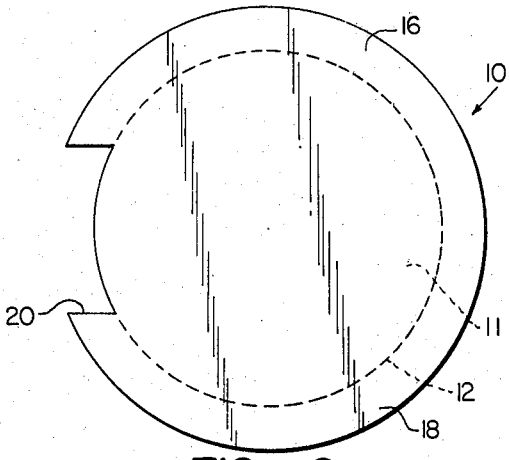
FIG. 2 is a plan view of the embodiment of FIG. 1.

FIGS. 1 and 2 illustrate an embodiment of the present invention in the form of a sound hole plug, generally designated 10. The plug 10 has a securement portion 12 adapted to be inserted within the sound hole 13 of a guitar and to hold the plug therein by forming a press fit with the top plate 15 of the guitar along the edge of the sound hole. Another portion 14 provides a head for the plug.

In the case of the plug 10 the securement portion 12 is a one-piece body of material of such size and shape as to be snugly receivable in the sound hole with which it is to be used. That is, the cross sectional size and shape of this portion is generally the same, but slightly larger than, the cross sectional size and shape of the sound hole opening. The portion 12 is further made of resiliently yieldable material such as felt, foamed plastic, foamed rubber or cork, so that the plug may be pressed into place by a small amount of force and so that once it is in place the frictional forces acting between the resilient material and the edge of the sound hole will prevent the plug from easily falling out or being shaken loose.

The head portion 14 is in the form of a rigid plate 18 attached to the flat top surface 11 of the securement portion 12. The plate 18 completely covers the flat surface 11 of the portion 12 and has an edge portion 16 which extends radially outwardly beyond the perimeter of the portion 12 along most of the length of that perimeter and has a flat surface 17 adapted to face the top plate 15 of the guitar with which the plug is used. That is, as best shown in FIG. 2, the edge portion 16 extends a substantial distance around the perimeter of the portion 12 and is absent along one part of the perimeter to define a notch 20 on one side of the plug 10. The notch 20 provides a relief to accommodate the neck of a guitar wherein the neck extends downwardly into or close to the sound hole, thereby allowing the edge portion 16 of the plate to flatly engage the guitar face when the plug 10 is received in the sound hole.

The plate 18 and the securement portion 12 may be attached to one another in any number of ways, but in the embodiment shown are attached together by a layer of glue.

Figure 3:
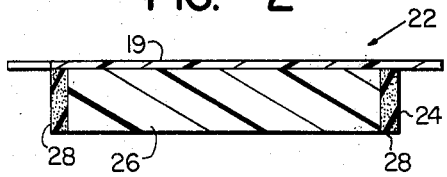
FIG. 3 is a cross sectional elevational view of another embodiment of this invention.

Although the securement portion 12 of the plug 10 has been described as a one-piece body of resiliently yieldable material, it should be noted that in accordance with the broader aspects of this invention it is not necessarily so constructed. FIG. 3, for example, is a cross-sectional view of a plug 22 comprising another embodiment of the invention and which is similar to the plug 10 of FIGS. 1 and 2 except for having a securement portion 24 made up of an inner portion 26 covered by a peripheral portion 28. The inner portion 26 may be constructed of a relatively rigid material, such as wood or plastic, while the peripheral portion 28 is a layer of resilient material.

Figure 4:
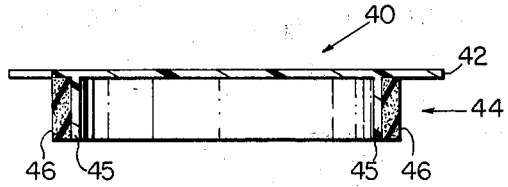
FIG. 4 is a cross sectional elevational view of a further embodiment of this invention.

FIG. 4 is a cross sectional view of another plug 40, constructed in accordance with the invention and having its head portion 42 and a part 45 of its securement portion 44 formed or molded as a unitary piece. The part 45 of the securement portion formed with the head portion could be solid in cross section, as in the portion 26 of FIG. 2, but as shown it is of a inverted cup shape and consists basically of a hollow cylindrical wall extending axially from the head portion 42. Surrounding the part 45, and attached to it, is a ring 46 of resiliently yieldable material.

Figure 5:
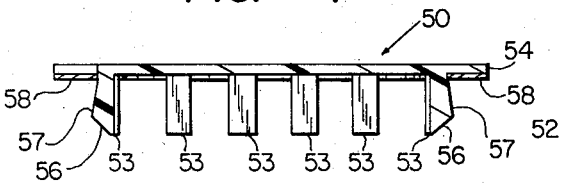
FIG. 5 is a cross sectional elevational view of a still further embodiment of this invention.

FIG. 5 is a cross sectional view of still another plug 50 constructed in accordance with this invention. In this plug 50, the securement portion 52 is comprised of a plurality of resilient fingers 53, 53 extending from the head portion 54. The resilient fingers 53, 53 are spaced from one another and positioned along the perimeter of a circle having a diameter roughly equal to the diameter of the sound hole opening. Each finger 53 has inclined detent cam surfaces 56 and 57, as shown, on its side facing radially outward from the formed circle so that each finger 53 may deform radially inwardly during the insertion of the plug and return toward its undeformed condition once the plug has been inserted. The cam surfaces 57, 57 collectively hold the inserted plug in place by engagement with the top plate of the guitar along the edge of the sound hole. A thin layer of felt 58 may also be applied to the underside of the head portion, as shown, to act as a cushion between the head portion 54 and the top plate of the associated guitar.

Figure 6:
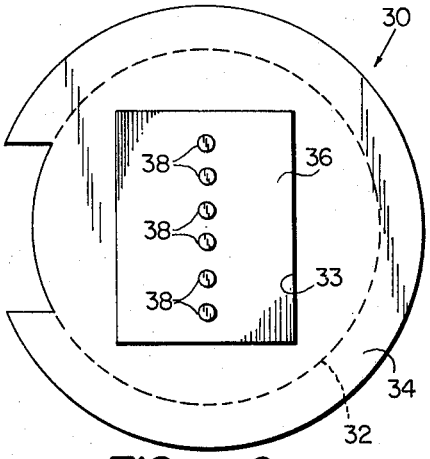
FIG. 6 is a plan view of still another embodiment of this invention.
Figure 7:
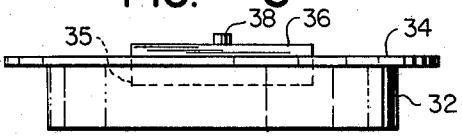
FIG. 7 is an elevational view of the embodiment of FIG. 6.

FIGS. 6 and 7 illustrate yet another plug, indicated generally at 30, embodying this invention and including a magnetic pickup 36. The magnetic pickup is attached to the head portion 34 of the plug 30 in such a manner that the pickup magnets 38, 38 are properly associated with the guitar strings of a guitar when the plug 30 is fitted into its sound hole. The construction of the head and securement portions 34 and 32, respectively, of the plug 30, except for the addition of the pickup 36, is shown to be similar to that of the plug 10 of FIGS. 1 and 2. That is, as best shown in FIG. 7, the pickup 36 is received in an opening 33 in the head portion 34 and in a recess 35 in the securement portion 32, the head portion 34 being similar to the plate 18 of FIGS. 1 and 2 and the securement portion 32 being similar to the securement portion 12 of FIGS. 1 and 2 except for the opening 33 in the head portion 34 and the recess 35 in the securement portion 32. Since the addition of a magnetic pickup to an acoustic guitar will convert a standard acoustic guitar into an acoustic electric one, the single device 30 provides for guitar conversion as well for feedback reduction.

The aforementioned descriptions are intended as illustrations and not as limitations, and it will be understood that numerous modifications may be made to the feedback reducing device without departing from the spirit of the invention.

I claim:

1. A feedback reducing plug for insertion into a sound hole formed in the top plate of an acoustic electric guitar, or into the sound hole formed in the top plate of an acoustic guitar when converting such acoustic guitar to an acoustic electric one, and adapted to be easily manually inserted into and removed from such sound hole without the need for tools and to hold its place in such sound hole after insertion until manually removed, said plug comprising:

a head portion in the form of a rigid plate adapted to overlie the top surface of a top plate such as aforesaid and to completely cover the sound hole therein, and a securement portion extending from said head portion, said securement portion being adapted to extend into said sound hole and having means for holding said plug in place relative to a top plate such as aforesaid by a press fit engagement with the edge surface of said sound hole which edge surface extends from the top surface to the bottom surface of said top plate and defines said sound hole.

2. A feedback reducing plug as defined in claim 1 wherein said means for holding said plug in place includes a quantity of resiliently deformable material adapted to snugly engage said sound hole defining edge surface of said top plate when said securement portion extends into said sound hole.

3. A feedback reducing plug as defined in claim 1 wherein said head portion is a flat rigid plate and wherein said securement portion is a one-piece body of resiliently yieldable material of such size and shape as to snugly engage said sound hole defining edge surface of said top plate when said securement portion extends into said sound hole.

4. A feedback reducing plug as defined in claim 1 wherein said head portion is a flat rigid plate and wherein said securement portion includes an inner portion made up of a relatively rigid material and a peripheral portion surrounding the periphery of said inner portion and made of a resilient material, said inner and outer portions of said securement portion being of such size and shape that said outer portion of said securement portion snugly engages said sound hole defining edge of said top plate when said securement portion extends into said sound hole.

5. A feedback reducing plug as defined in claim 1 wherein said head portion has a flat surface adapted to face the top plate of the guitar with which it is used and wherein said securement portion includes a ring integral with said head and extending from the plane of said flat surface.

6. A feedback reducing plug as defined in claim 5 wherein said securement portion includes a layer of resilient material attached to and surrounding said ring for engaging said top plate adjacent the edge of said sound hole when said plug is secured therein.

7. A feedback reducing plug as defined in claim 1 wherein said head portion has a flat surface adapted to face the top surface of said top plate and wherein said securement portion includes a plurality of resilient fingers extending from said flat surface of said head portion, said resilient fingers being spaced from one another along a path of such size and shape that said fingers snugly engage said sound hole defining surface of said top plate when said securement portion extends into said sound hole.

8. A feedback reducing plug as defined in claim 7 wherein each of said resilient fingers has a pair of inclined outwardly facing detent cam surfaces.

9. A feedback reducing plug as defined in claim 1 wherein said securement means has a perimeter and wherein said head portion has an edge portion which extends radially outwardly beyond said perimenter and which also extends a substantial distance around said perimeter, said edge portion being absent along one part of said perimeter to define a notch for acccommodating the neck of the guitar with which said plug is used.

10. A feedback reducing plug as defined in claim 1 wherein said plug further comprises:

a magnetic pickup mounted on said head portion for cooperation with the strings of the guitar with which it is used.

11. A feedback reducer device for use with an acoustic electric guitar, or for use in converting an acoustic guitar into an acoustic electric one, which guitar has a sound hole formed in its top plate and strings stretched across said sound hole, said device being adapted to be easialy manually inserted into and removed from such sound hole without the need for tools and to hold its place in such sound hole after insertion until manually removed, said device comprising in combination: a head portion in the form of a rigid plate for completely covering said sound hole, a securement portion extending from said head portion, said securement portion being of such size and shape as to have a press fit engagement with the edge surface of said sound hole which edge surface extends from the top surface to the bottom surface of said top plate and defining said sound hole, and a magnetic pickup mounted on said head portion for cooperation with said strings.

12. A feedback reducing device as defined in claim 11 wherein said securement portion is a one-piece body of material and wherein said head portion is in the form of a generally flat plate attached to said one-piece body and having a opening, and wherein said magnetic pickup is mounted within said plate opening and is partially received in said one-piece body.

* * * * *